US005369927A

United States Patent [19]

Counihan

[11] Patent Number: 5,369,927

[45] Date of Patent: Dec. 6, 1994

[54] RESILIENT FLOOR SYSTEM

[76] Inventor: James Counihan, 50 Griffin Mill Rd., Piedmont, S.C. 29673

[21] Appl. No.: 12,123

[22] Filed: Feb. 1, 1993

Related U.S. Application Data

[63] Continuation-in-part of Ser. No. 870,926, Apr. 20, 1992, abandoned.

[51] Int. Cl.[5] ..... E04F 15/22

[52] U.S. Cl. ..... 52/403.1; 52/480; 52/710; 52/718.06

[58] Field of Search ..... 52/479, 480, 481, 718.06, 52/370, 371, 376, 489, 401, 402, 403, 508, 710, 481.1, 481.2, 403.1

[56] References Cited

U.S. PATENT DOCUMENTS

| | | | |
|---|---|---|---|
| 498,344 | 5/1893 | Williams | 52/403 |
| 1,342,610 | 6/1920 | Wheeler | 52/480 X |
| 1,587,355 | 6/1926 | Raun | 52/370 |
| 1,693,655 | 12/1928 | Murphy | 52/481 |
| 2,862,255 | 12/1958 | Nelson | 52/480 X |
| 3,271,916 | 9/1966 | Omholt | 52/480 |
| 3,387,422 | 6/1968 | Wanzer | 52/410 |
| 4,831,806 | 5/1989 | Niese et al. | 52/391 |
| 4,856,250 | 8/1989 | Gronau et al. | 52/480 |
| 4,879,856 | 11/1989 | Jones et al. | 52/480 X |
| 4,879,857 | 11/1989 | Peterson et al. | 52/403 |

FOREIGN PATENT DOCUMENTS

| | | | |
|---|---|---|---|
| 0024452 | 5/1936 | Australia | 52/403 |

*Primary Examiner*—Carl D. Friedman
*Assistant Examiner*—Robert J. Canfield
*Attorney, Agent, or Firm*—Henry S. Jaudon; Cort Flint

[57] ABSTRACT

A floating support system for attaching flooring to a floor base comprising a plurality of transversely spaced sleepers arranged in longitudinal lines across a base floor. Each of the sleepers consists of rectangularly shaped studs arranged end to end along the longitudinal lines. Outwardly directed shoulder members extend along opposed sides of the studs so that a plurality of longitudinally spaced floor clips which are attached to the base floor along the longitudinal lines may extend over the shoulder members to secure the sleepers to the base floor. Cushion members are arranged below the studs in longitudinally spaced relationship. This provides sleepers which are restricted from lateral motion but have limited vertical movement through compression of the cushion members. This provides a level resilient flooring attached to the floor base.

25 Claims, 8 Drawing Sheets

RESILIENT FLOOR SYSTEM

This application is a continuation-in-part of Ser. No. 07/870,926 filed Apr. 20, 1992 now abandoned.

BACKGROUND OF THE INVENTION

The present invention relates to an improved flooring bed comprising sleepers which are formed of studs, containment guides consisting of floor clips and leveling means consisting of cushioning pads.

Sleeper systems are frequently used to secure a floor to a base floor. Typically, the base floor is concrete while the floor is tongue and groove wood boards. The dimensions of the wood changes as the moisture content of the wood changes. This can cause buckling or cupping.

In order to limit moisture transfer between the concrete and the wood floor, it is desirable to elevate or separate the floor from the concrete.

Another typical feature of concrete floor is that they have a wavy surface formed by the concrete not being perfectly level when drying. In order to overcome transfer of these waves to the wood flooring, a certain amount of vertical shifting is required of the sleepers.

Various attempts have been made to provide a sleeper structure capable of satisfying these needs without total success. U.S. Pat. Nos. 3,387,422 (Wanzer); 4,831,806 (Niese, et al.); and 4,856,250 (Gronau, et al.) are three such attempts. Wanzer simply uses a moisture barrier over the base floor over which boards 16 are attached. Niese, et al. utilize a pair of sub-floors 12, 13 laid in a bias on the base floor. Gronau, et al. utilize elongated metal guide ways to partially encapsulate the nailing bed 30.

The instant invention has as its object to overcome the drawbacks of the prior art devices noted above.

Another object of the invention is to provide a sleeper which presents a stable yet resilient support for flooring.

Another object of the invention is to provide a sleeper arrangement which controls the effect of moisture variations in the flooring.

Another object of the invention is to provide a multifunctional pad which offers two stage resiliency which helps to justify unlevel concrete.

Another object of the invention is to provide a clip which holds the sleeper snug to the concrete which eliminates dead spots and buckling due to humidity.

SUMMARY OF THE INVENTION

This invention is directed to a floating support system for attaching flooring to a floor base. The support system comprises a plurality of transversely spaced sleepers arranged in longitudinal lines across the base floor with each of the sleepers consisting of rectangularly shaped studs arranged end to end. Outwardly, directed shoulder members are secured to and extend along opposed side portions of the sleeper members, A plurality of longitudinally spaced floor clips are attached to the base floor along the longitudinal lines with each floor clip having spaced vertical side walls. The sleeper members are received between the side walls which have inwardly directed tabs attached to their upper ends. These tabs extend over the shoulder members. Cushion members are arranged below the sleeper members in longitudinally spaced relationship. Each cushion member is attached to the sleeper member by attachment means. The arrangement provides sleeper members which are restricted from lateral motion by the side walls and are limited in upward movement by interaction between the tabs and the shoulder members but are allowed limited motion along a vertical axis by compression of the cushion members. Thus, a level resilient flooring may be attached to the floor base.

The studs may comprise a unitary wood piece having upper and lower surfaces which are approximately two and one-half inches in width and vertical side walls which are approximately one and one-half inches in height.

The shoulder members may be attached along one edge to a side clip. Each shoulder is arranged to extend along a plane substantially transverse to the plane of the side clip. A second shoulder member is arranged along a second edge of the side clip to extend oppositely from the first shoulder member. Longitudinal slots may be provided along the vertical side walls of the sleeper members to receive the second shoulder member.

The shoulder members may alternately comprise a portion of a rectangular plate with the opposite edge of the plate having knurls formed therealong. The longitudinal slots provided along the vertical side walls of the sleeper members are adapted to receive the opposite edge of the plates so that the knurls act to secure the plates in position.

The cushion members comprise a rectangularly shaped rubber pad having a width greater than the width of the stud members. The rubber pad includes attachment means which comprise opposed grooves into which a portion of the shoulder member are received. Also, the cushion members may comprise a rectangularly shaped rubber pad having a width which substantially corresponds to the width of the sleeper. In this case, the attachment means comprise ears extending from opposite side faces of the cushion member. The ears receive tack members which secure the pad to the sleeper. The cushion members are provided with a plurality of protruding buttons arranged to extend from a lower surface thereof. There are four equally spaced buttons arranged on the lower surface.

The clips and the pads are longitudinally spaced along the longitudinal lines. The pads are arranged along the longitudinal lines to be coincident with the clips and also intermediate of the clips.

The bottom wall of each of the clips extends between and interconnects with the vertical side walls. The bottom wall is shaped to have an intermediate portion which is bowed upwardly. The attachment means passes through this upwardly bowed portion and into the floor base so that the clip is resiliently secured against the floor base.

The sleepers comprise upper and lower studs secured together along their length. Metal strips are arranged between the upper and lower studs in spaced manner along the longitudinal line. The shoulder members are arranged intermediate opposed ends of the metal strips. Transversely opposed shoulder members are interconnected by a metal plate. The metal strips and metal plates act to deflect upwardly the brads to securely fasten them in place. Also, opposed ends of the upper and lower studs are arranged to be of different lengths so that when the sleepers are arranged end to end one of the ends overlaps the other of the ends. These opposed ends of the sleepers may be arranged in spaced relationship.

A sleeper of the type used to attach a covering floor to a base floor comprising a plurality of elongate studs arranged in spaced end to end relation across the base floor with end portions of the studs being formed with a recessed shoulder so that adjacent end portions overlap. The studs comprise plywood strips secured together in vertical relationship along their length with the lower of the strips being of a greater width than the remainder of the strips so as to form a shoulder along each side of the studs.

Resilient pads are attached in spaced relationship along the lower surface of the studs. The pads include a rectangular body portion having a width and a length which are substantially equal to the width of the lower surface of the studs. The height of the pads is approximately one-half inch. A plurality of buttons project from a lower surface of the pads. The buttons act to elevate the pad body from the base floor. An attachment ear extends from opposed sides of the pad body. Attaching staples pass through the ears to secure the pads to the lower surface.

Clip members are arranged longitudinally of the studs. The clip members comprise a lower surface having an upward bow. Two side members are attached to opposite ends of and extend substantially perpendicular to the lower surface. Inwardly directed tabs are connected to upper edges of the side members. The arrange functions with the clip members secured in position on the floor base along spaced longitudinal lines and the sleepers secured in position between the side members of the clips by the tabs being positioned over the shoulders. This provides that the sleepers are prevented from transverse movement by the side members and are allowed controlled vertical movement by the elastic pads. The vertical movement is limited by the tabs.

The resilient pads may be formed of recycled rubber. The resilient pads may have four buttons, one located in the proximity of each corner of the resilient pad. The buttons protrude approximately one-quarter inch from the lower surface and offer reduced resistance to compression relative to the resistance to compression of the pad body portion.

There are at least three clips arranged along each stud and there are at least four pads arranged beneath each stud. The pads are arranged between the clips and coincident with at least certain of the clips.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
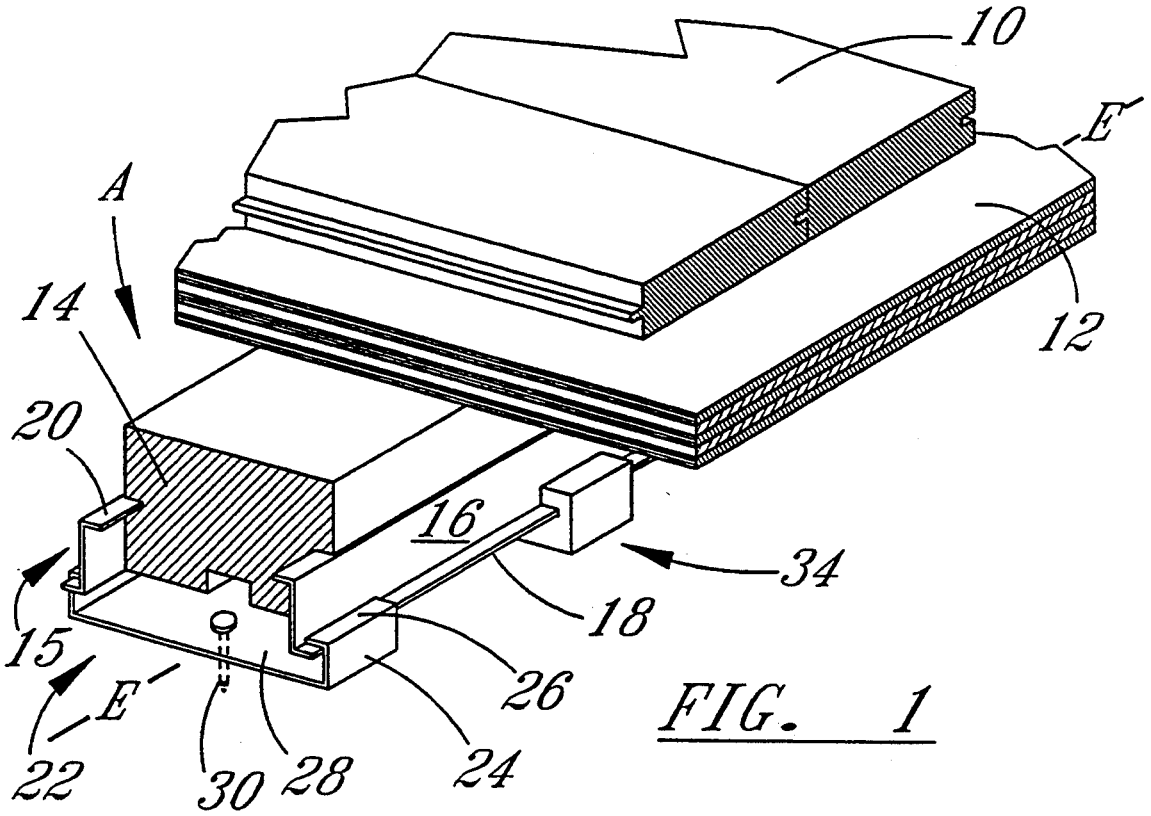
FIG. 1 is a sectional perspective view showing a sleeper in combination with sub-flooring and flooring.
Figure 2:
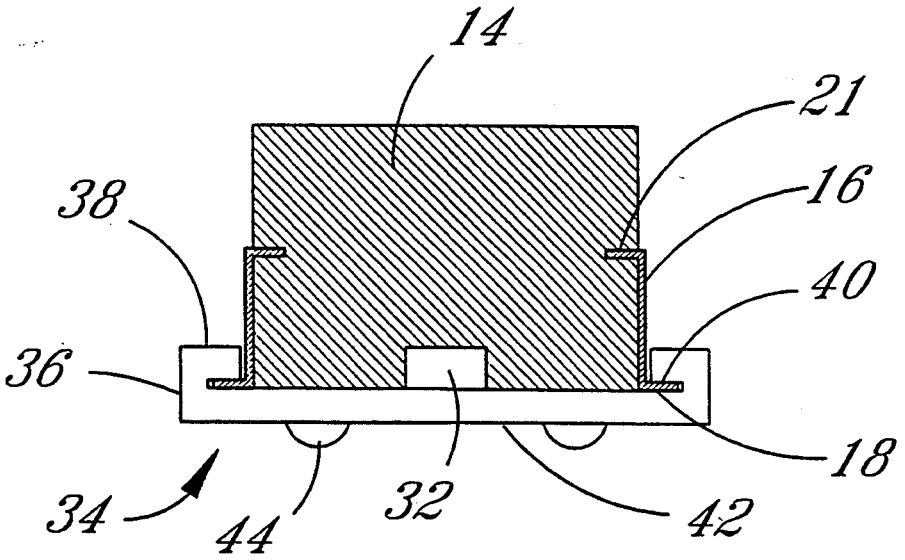
FIG. 2 is an end view of the sleeper shown in FIG. 1.
Figure 3:
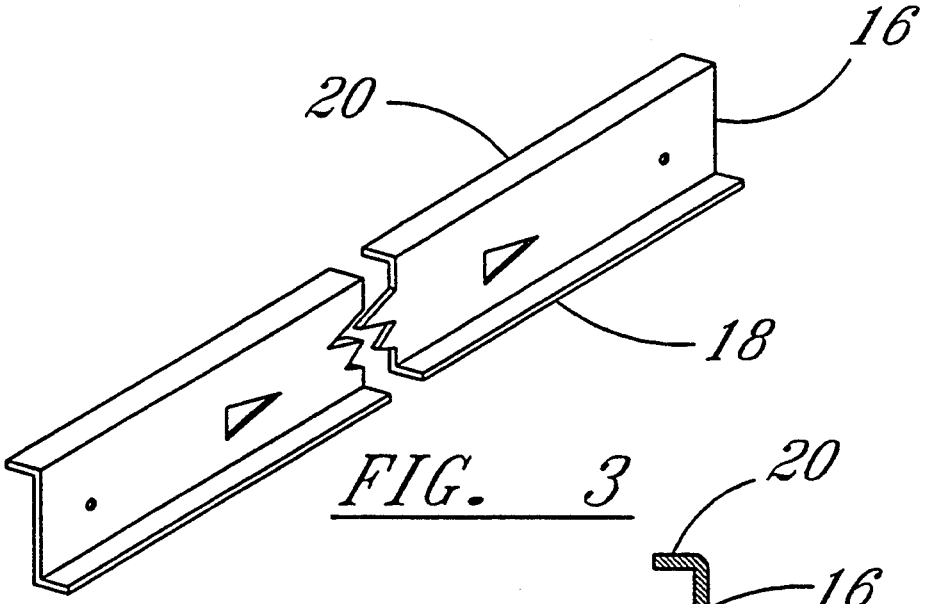
FIG. 3 is a perspective view of a preferred embodiment of the side clip of the invention.
Figure 4:
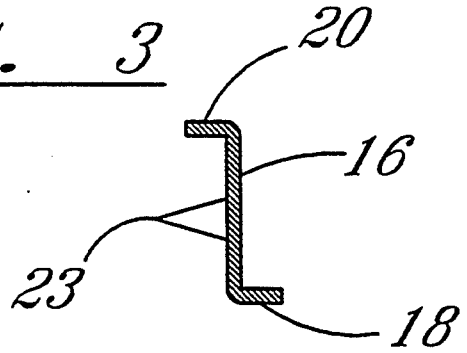
FIG. 4 is an end view of the clip of FIG. 3.
Figure 5:
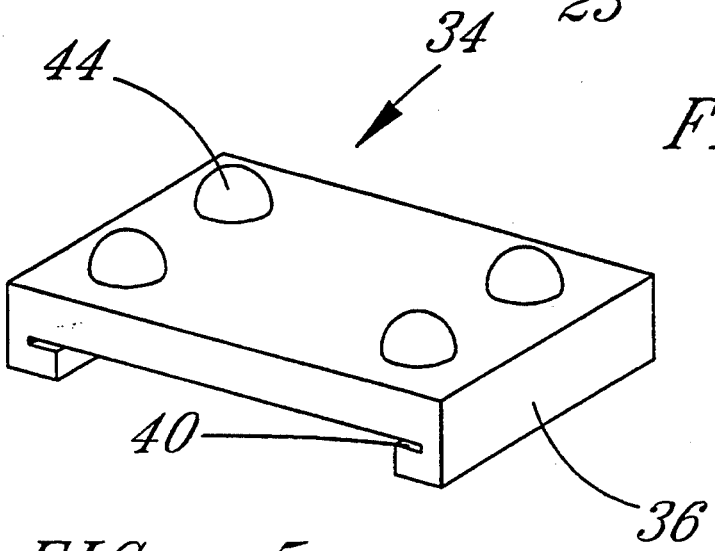
FIG. 5 is a perspective view of a preferred embodiment of the cushion member.
Figure 6:
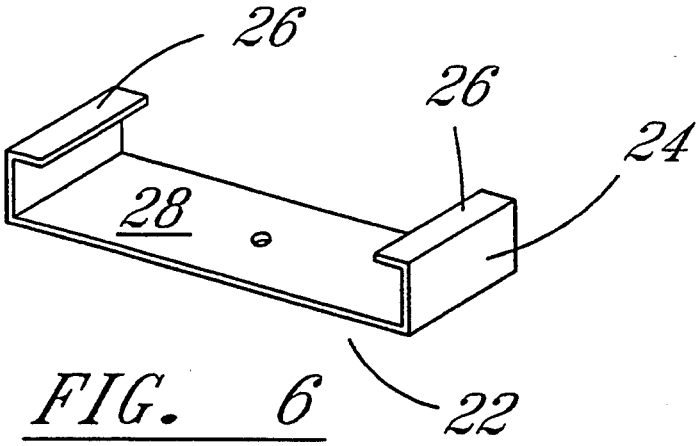
FIG. 6 is a perspective view of a preferred embodiment of the floor clip.

Turning now to FIGS. 1–6, the sleeper A having flooring 10 and sub-flooring 12 attached can be seen. In practice a plurality of sleepers A are arranged in spaced side-by-side relationship along spaced parallel lines E across an entire base floor. A Sleeper A extends along each of the lines also across the entire base floor. A sub-floor 12 is then attached to the sleepers and a flooring 10 is attached to the sub-flooring.

Each sleeper A consists of a plurality of studs 14 which are arranged in end to end relationship. Studs 14 preferably are formed of a unitary wood piece which is approximately two and one-half inches wide and one and one-half inches high. Midway each vertical side, a slot 21 is cut to extend the entire length of stud 14.

Side clips 15 which are "Z" shaped are attached to each vertical side of studs 14. Each side clip 15 which is formed of 16 gauge galvanized steel and consist of a body portion 16 which is approximately four feet in length and one inch in height. A lower shoulder 18 and an upper shoulder 20 are attached to opposite edges of body 16 to extend in parallel, opposite directions. Shoulders 18 and 20 are approximately one-quarter inch in width.

Side clips 15 are attached to opposite sides of studs 14 in opposed relationship. The clips are spaced along the length of sleeper A at selected intervals. Side clips 15 are attached to studs 14 by inserting shoulder 20 into the horizontal side slot so that body 16 is flush against the vertical side of the stud. Shoulder 18 is arranged to be approximately parallel with the lower surface of stud 14. Side clips 15 are preferably secured to sleeper A by spikes 23 formed in body 16, however, nails or brads are acceptable alternatives.

Floor clips 22, which are substantially U-shaped, are secured to the base floor by one and one-half inch nails 30. Clips 22 are positioned along longitudinal lines E at approximately sixteen inch intervals.

Floor clips 22 include a pair of three-quarter inch vertical sides 24 attached to outer edges of base portion 28. Tabs 26 extend inwardly from upper edges of sides 24. Base 28 and tabs 26 extend along parallel planes.

Elastic cushion or resilient pad members 34 are formed of rubber, which preferably has been recycled. Cushion members 34 consist of a base 42 and a pair of vertical side walls 36. Slots 40 are formed along the lower, inner side of side walls 36 adjacent to the upper surface of base 42. Buttons 44 are arranged adjacent each corner of the lower surface of base 42. Cushion members 34 are approximately one-half inch thick with buttons 44 adding an additional one-quarter inch of thickness. The cushion members are formed to be approximately three and one-half inches by two inches.

Cushion or resilient members 34 are attached along the lower surface of studs 14 by engaging shoulders 18 in slots 40. The cushion members are arranged along sleeper A, so that they are positioned between floor clips 22, at approximately every twelve inches. Studs 14 are positioned between side walls 24 so that shoulder members 18 are positioned below tabs 26. This arrangement provides that sleeper A is prevented from moving transversely by side members 24 and is restrained in vertical movement by tabs 26 acting on shoulders 18. Limited vertical movement is allowed by compressing first tabs 44 and then body portion 42 of cushion members 34. This limited movement allows for a leveling of the sleepers across a base floor having waves. Also, a two stage resiliency is provided the top flooring.

Figure 20:
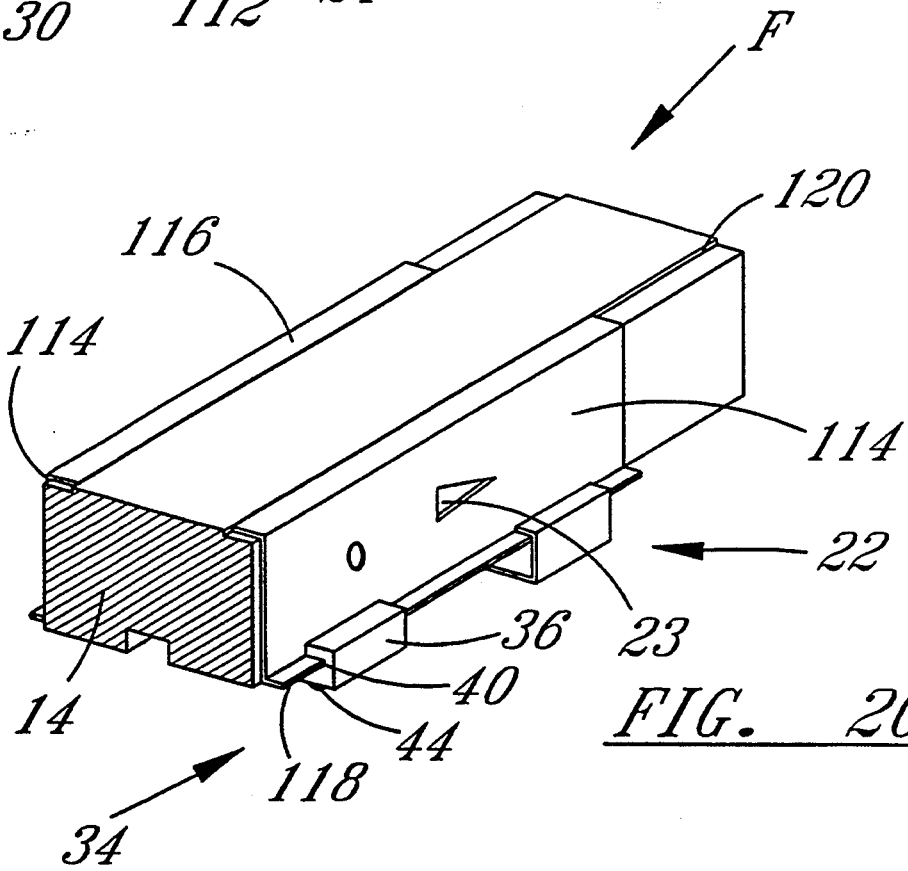
FIG. 20 is a sectional perspective view of an alternative arrangement of the sleeper arrangement of FIGS. 1–6.

FIG. 20 shows an alternative sleeper arrangement F of the sleeper A. Sleepers F are arranged in side by side relationship across a base floor and a subfloor is attached just as described for sleeper A.

Sleeper F utilizes side clips 114 which are "Z" shaped and are attached to each vertical side of studs 14. Preferably the side clips 114 are formed of 16 gauge galvanized steel although slightly lighter or heavier gauges may be used. Side clips 114 are approximately four feet in length and one and one half inches in height and are adapted to be secured with the side walls of studs 14. Side clips 114 include an upper shoulder 116 which is adapted to fit in slight channel 120 formed on the outer upper edges of the studs 14 and a lower shoulder 118 extends outwardly away from the side walls in substantially parallel relationship with the lower surface of stud 14. Side clips 114 are secured with studs 14 in any usual manner, preferably by spikes such as spikes 23 of clip 15. Upper shoulder 118 may simply be arranged above the upper surface of stud 14 without using a channel. Shoulders 116, 118 are approximately one half inch in length.

Figure 19:
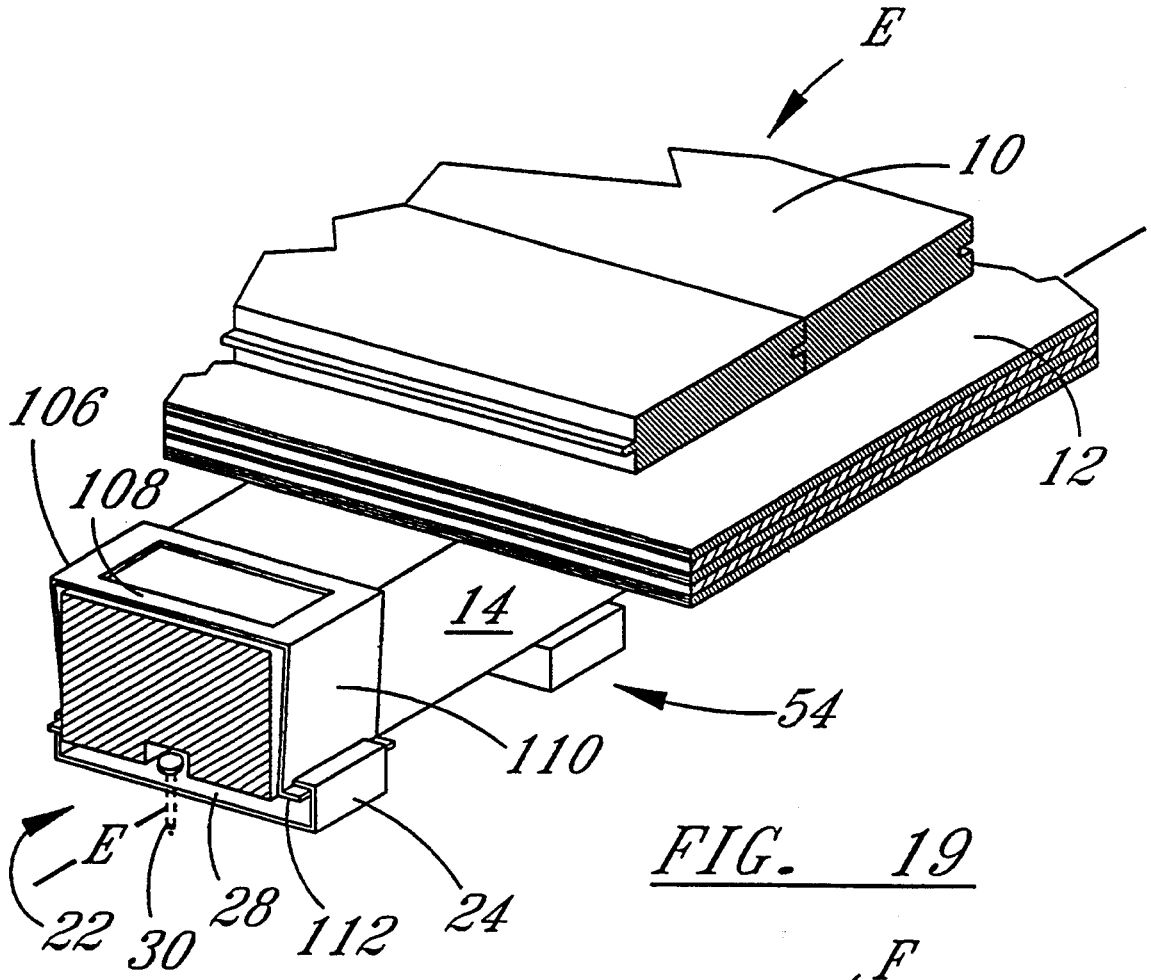
FIG. 19 is a sectional perspective view of a fifth embodiment of a sleeper of the invention in combination with sub-flooring and flooring.

Side clips 114 cooperate with floor clips 22 and with elastic cushion members 34 in the manner previously described. Cushion members 54 could also be arranged with the sleeper arrangement F as shown in FIG. 19.

Cushion member 54 is described in detail later in the description.

Figure 7:
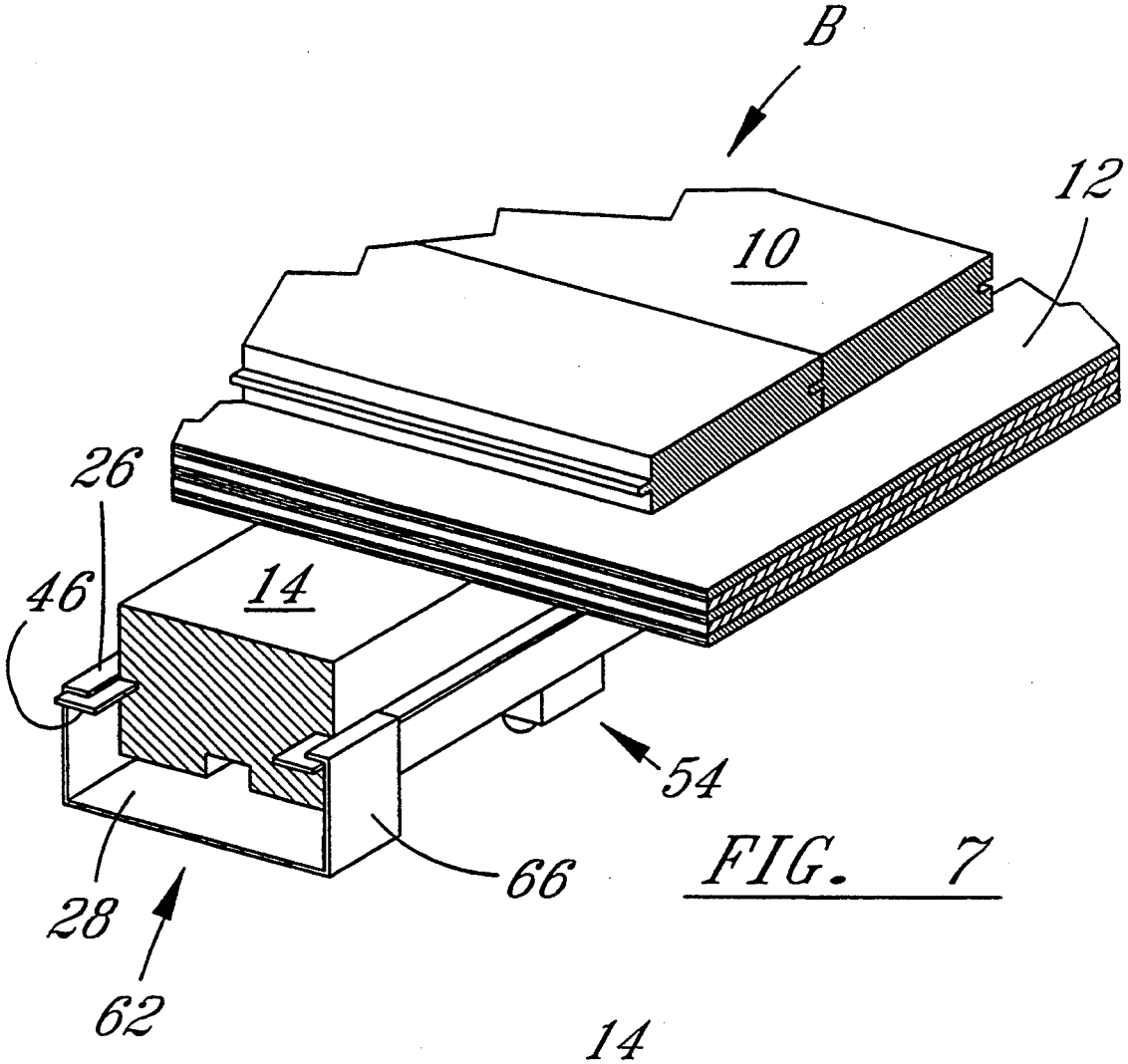
FIG. 7 is a sectional perspective view showing a second embodiment of a sleeper in combination with sub-flooring and flooring.
Figure 8:
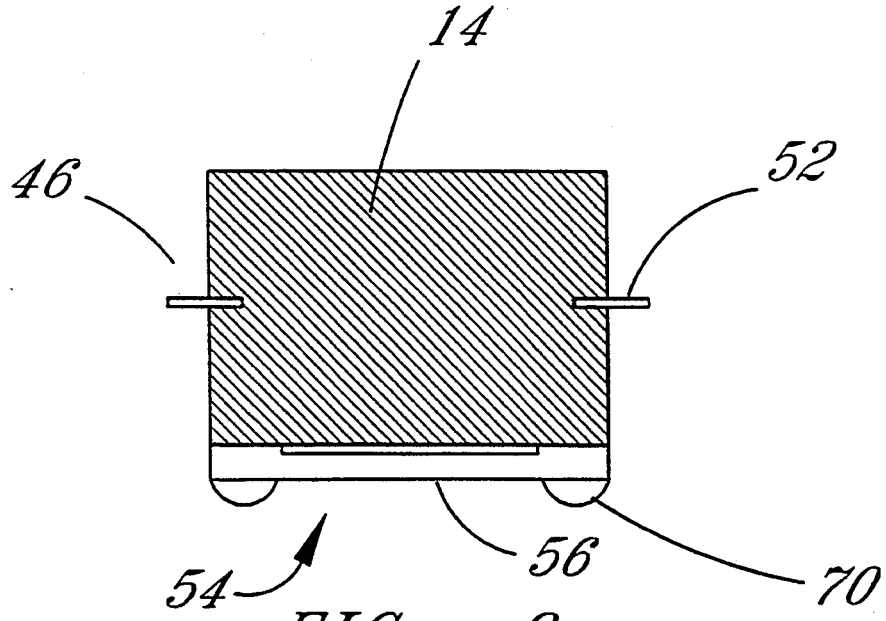
FIG. 8 is an end view of the sleeper shown in FIG. 7.
Figure 9:
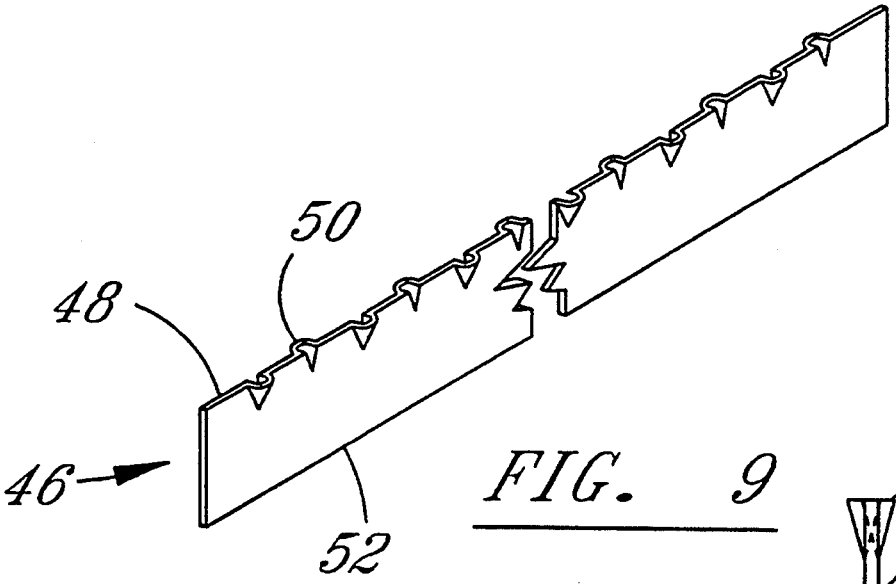
FIG. 9 is a perspective view of a second embodiment of a side clip.
Figure 10:
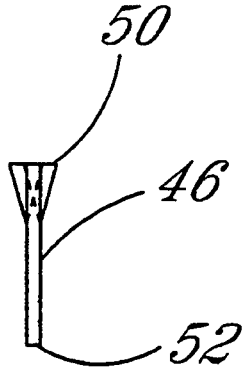
FIG. 10 is an end view of the side clip shown in FIG. 9.
Figure 11:
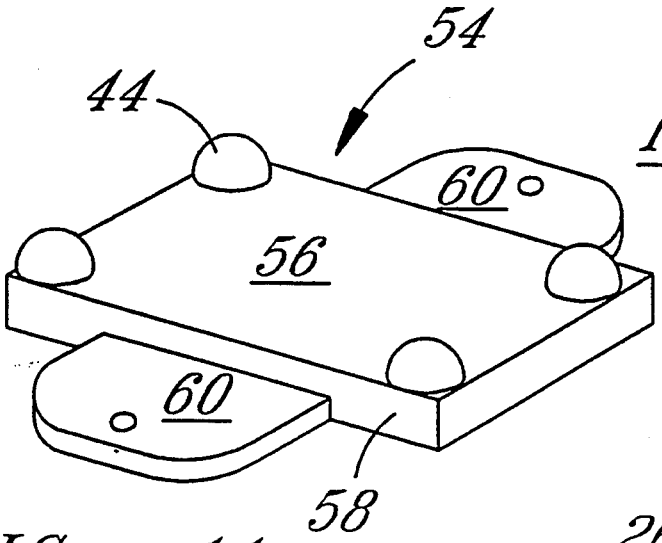
FIG. 11 is a perspective view of a second embodiment of a cushion member.
Figure 12:
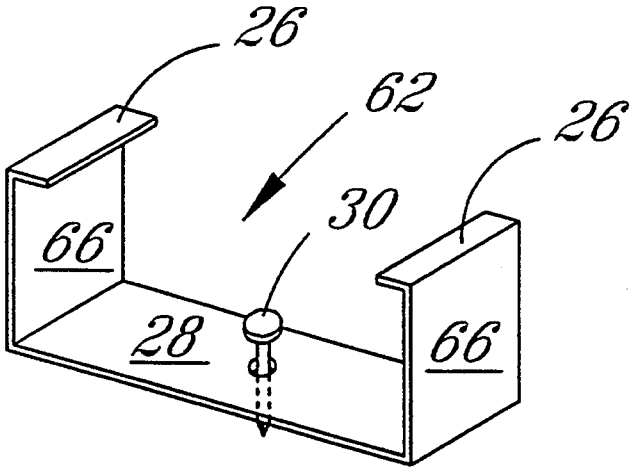
FIG. 12 is a perspective view of a second embodiment of a floor clip.
Figure 13:
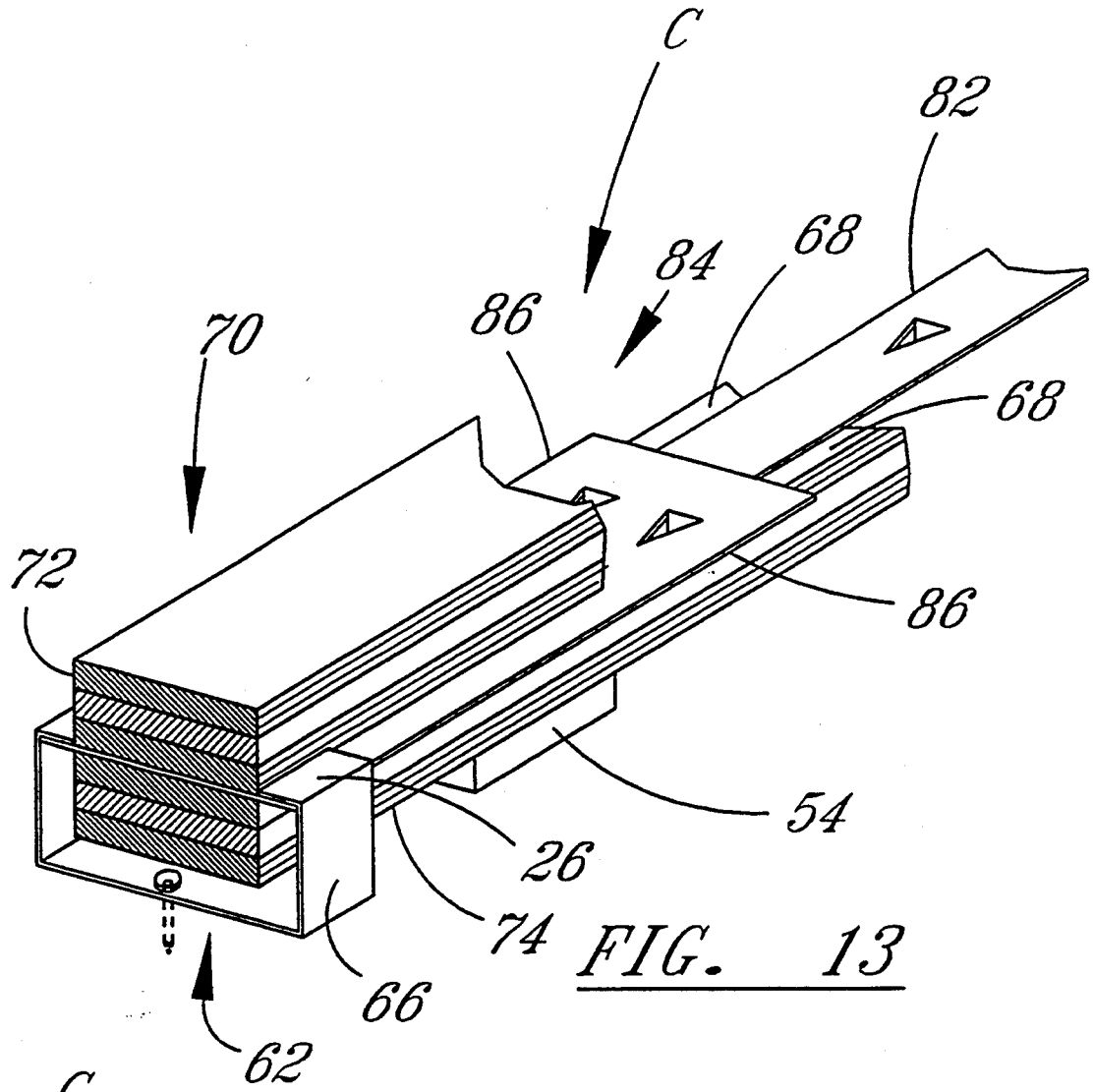
FIG. 13 is a sectional perspective view of a third embodiment of a sleeper member of the invention.

FIGS. 7–12 comprise a second embodiment of the invention. Sleeper B as shown in FIG. 7 consists of studs 14, floor clips 62, and cushion member 54 to which sub-flooring 12 and flooring 10 is attached.

Studs 14 are constructed as described in the embodiment of FIG. 1–6.

Floor clips 62 are of substantially the same U-shaped structure as floor clips 22 and like elements are identified with the same numerals. The primary difference between floor clips 22 and 62 is that sides 66 are approximately one and three-quarter inches in height.

Side clip 46 is formed of a rectangular metal member which is approximately three-quarters of an inch in width and six inches in length. Edge 48 of side clip 46 has knurls 50 formed therealong. Edge 52 is smooth.

Elastic cushion or resilient pad 54 is formed of rubber or other suitable elastic material and like cushion 34 has four one-quarter inch buttons 44 formed at each corner of the lower face of body portion 56. Body portion 56 is approximately two and one-half inches by two inches along adjacent sides and approximately one-half inch thick. Ears 60 extend from a pair of opposed side faces to provide an area to receive securing nails or brads.

Each sleeper B is arranged along horizontal lines across a base floor in the same manner as is sleeper A. Floor clips 62 are secured to the base floor by nails 30 at sixteen inch intervals along the horizontal lines.

Side clips 46 are attached to studs 14 by inserting edge 48 into the horizontal slots 21 formed in each side of the stud. Knurls 50 secure side clips 46 in position so that shoulders formed by edge 52 protrude from opposed sides of the stud. Cushion or resilient pad members 54 are attached at eleven inch intervals to the lower surface of the studs. Sleeper B is formed by placing stud ends along the horizontal lines. Tabs 26 are arranged over shoulders 52 to limit vertical movement of the sleepers. Cushion members 54 through compression allow a certain amount of vertical motion for sleeper B so that an elastic level of support is presented to which sub-flooring 12 and flooring 10 may be attached.

Sleeper C, shown in FIGS. 11–15, comprises a third embodiment of the invention.

Studs 70 which are formed of two strips 72, 74 of three-quarter inch plywood secured together by brads inserted along the outside edges thereof. Between and along the center line of upper plywood strip 72 and lower plywood strip 74 are arranged metal strips 82 which are one inch wide and fifteen inches long. Metal strips 82 are attached to the lower strip 74 by nails or spurs. Metal strips 82 are arranged in spaced end to end fashion along each stud 70. Between certain metal strips 82 there is arranged a metal plate 84. Plates 84 are also secured to lower strip 74 by nails or spurs. Strips 72, 74 are secured together with two inch brads or staples 68 which are spaced every six inches on center. Brads 68 are arranged on each side of metal strips 82.

Each plate 84 is three inches wide and six inches long and includes a body portion 88 having a pair of outer edges 86. Outer edges 86 protrude from opposite side faces of studs 70 to form shoulder surfaces.

Cushion members 54 are secured to the lower surface of studs 70 by brads or tucks in similar fashion as in sleeper B. Floor clamps 62 are also arranged as in sleeper B.

Studs 70 are arranged in end to end fashion along horizontal lines as in sleeper A with cushions 54 resting on base floor 80 and tabs 26 arranged above the shoulders formed by edges 86 of plate 84.

Figure 14:
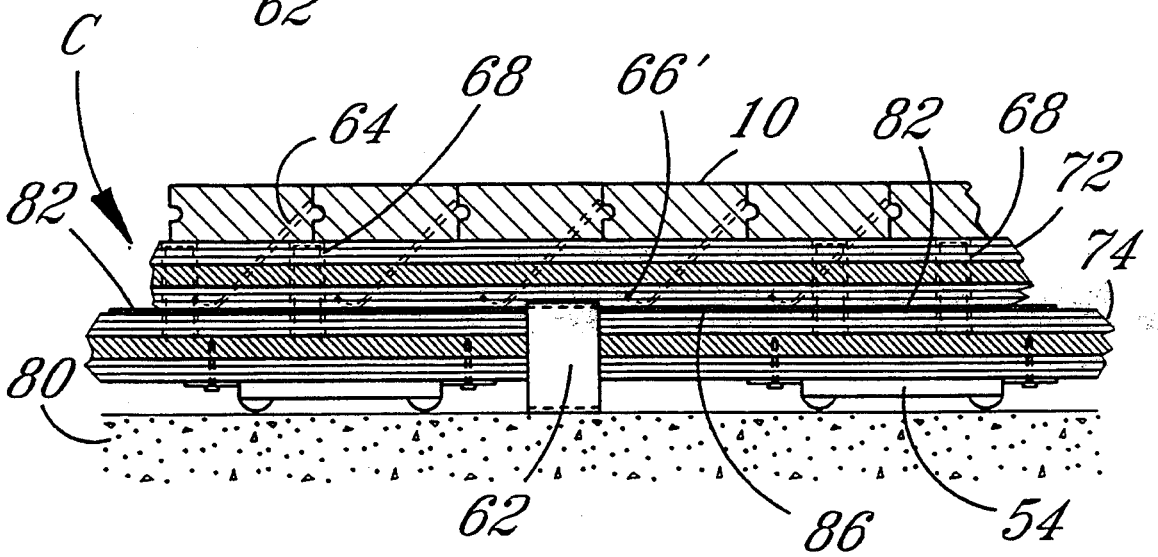
FIG. 14 is a sectional side view of the sleeper shown in FIG. 13 in combination with the sub-flooring and flooring.
Figure 15:
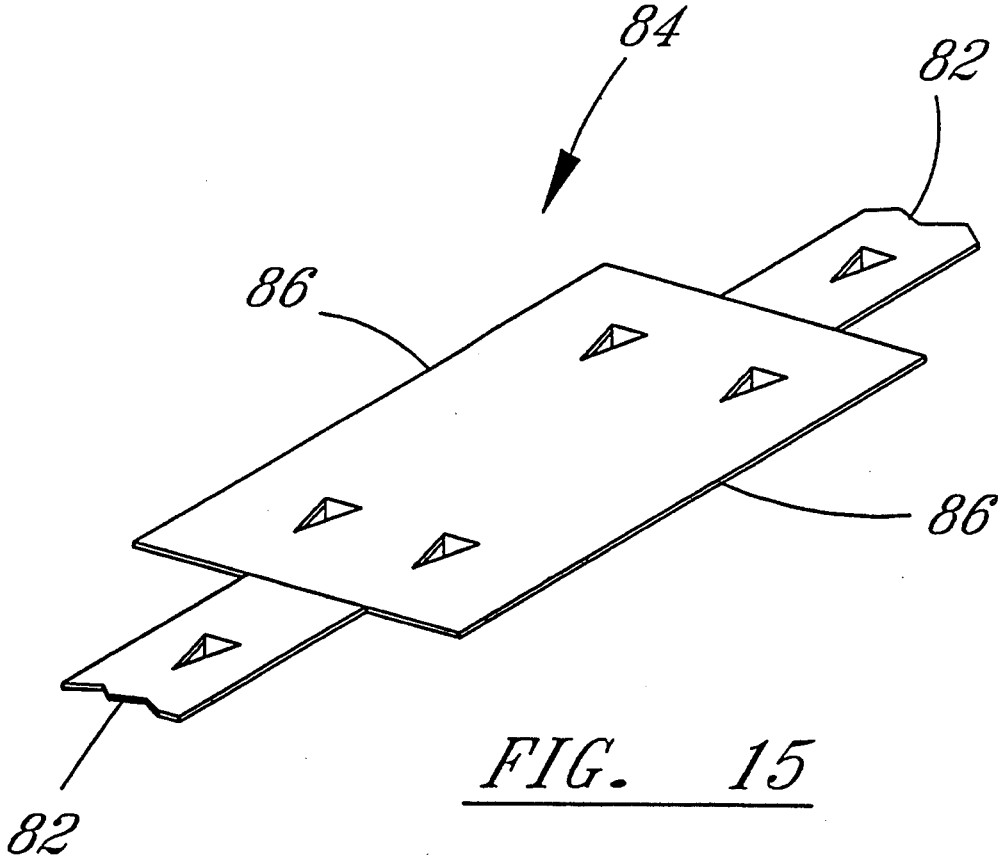
FIG. 15 is a perspective view of the side clip and strip members shown in FIG. 13.

FIG. 14 shows sleeper C secured to base floor 80 by means of floor clips 62. Cushions 54 provide for limited vertical movement between tabs 26 and base floor 80. Flooring 10 is attached to sleeper C by means of brads 64. The brads are of sufficient length to pass through flooring 10 and through plywood strip 72 with their forward ends 66 striking metal strips 82 or metal plate 84 which cause them to be bent upwardly to move securely lock the brads in position as clearly shown in FIG. 14.

Figure 16:
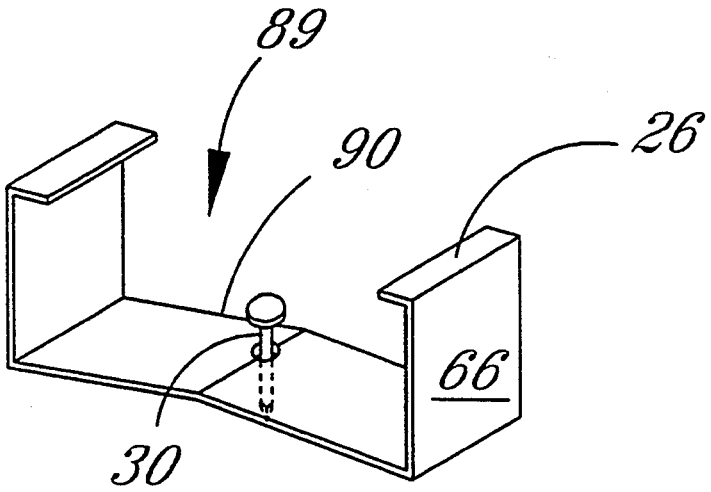
FIG. 16 is a perspective view of a third embodiment of a floor clip.

FIG. 16 shows an alternative construction for the floor clip here identified as 89. Floor clip 89 also generally U-shaped includes side walls 66 having inwardly directed tabs 26 as in floor clip 62. Base portion 90 of floor clip 89 bows upwardly so as to be separated from the base floor. When floor clip 89 is attached to the base floor by nail 30, base 90 directs a constant resilient force against the nail and base floor so that floor clip 89 is more securely held against the base floor.

Floor clip 89 may be used with sleepers B, C & D.

Figure 17:
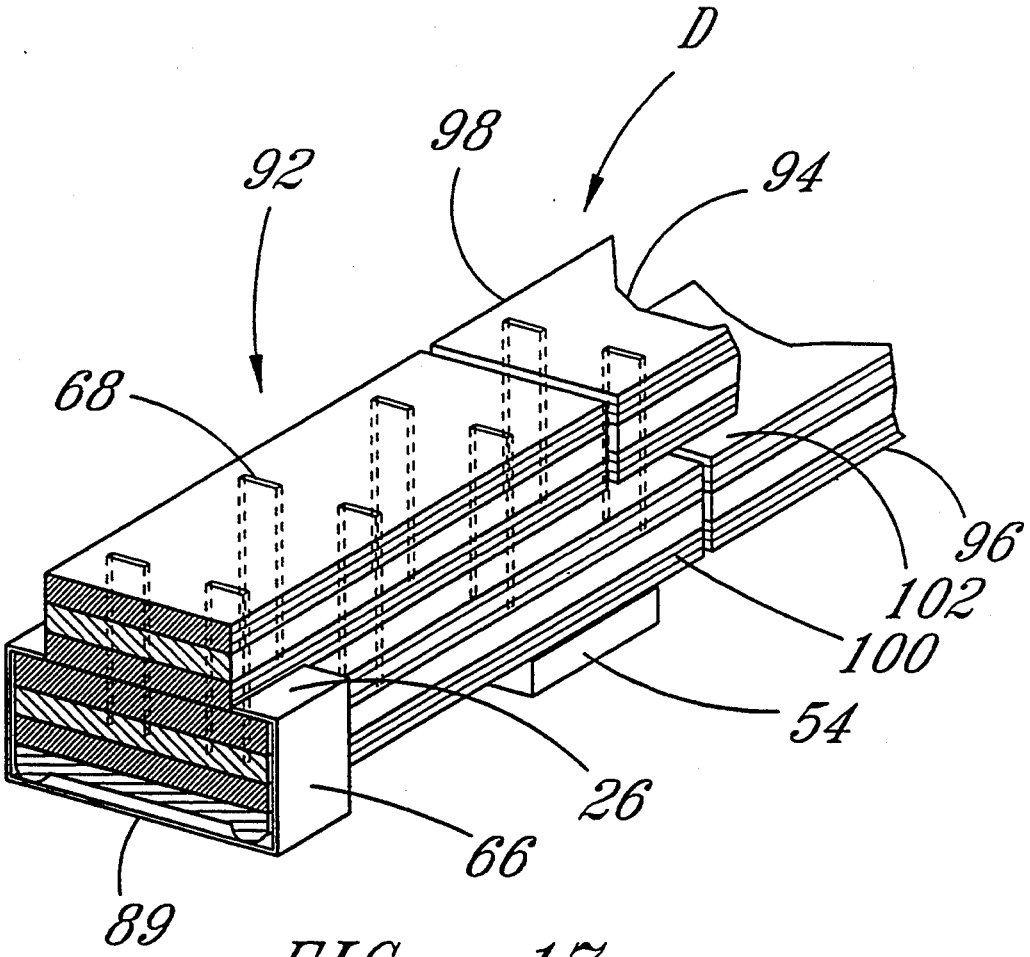
FIG. 17 is a sectional perspective of a fourth embodiment of a sleeper of the invention.
Figure 18:
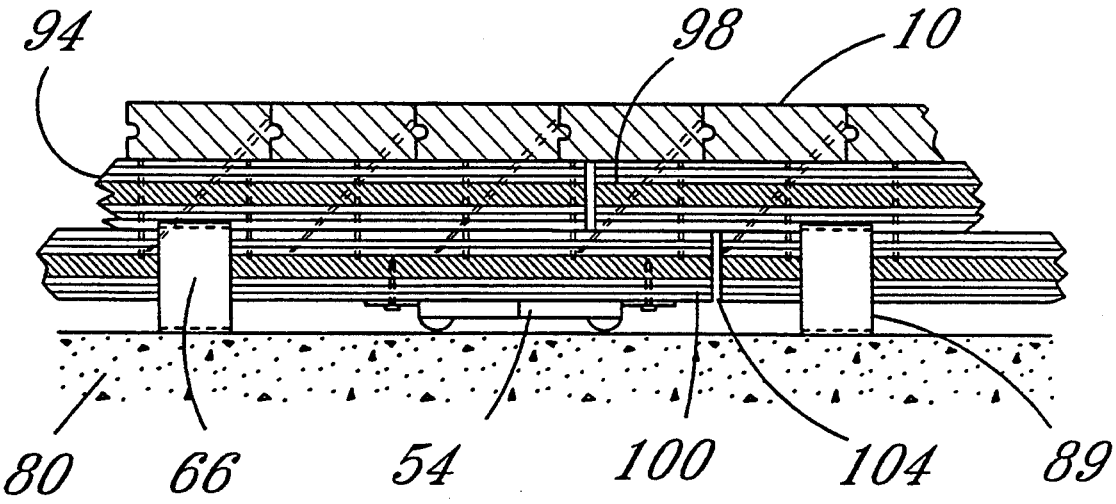
FIG. 18 is a sectional side view of the sleeper shown in FIG. 17 in combination with the sub-flooring and flooring.

FIGS. 11, 12, 16–18 show yet another embodiment of the invention. Sleeper consists of studs 92 formed of plywood cut into strips 94 and 96 and secured together with brads 68. Upper strip 94 is approximately two inches wide and three-quarter inch high while lower strip 96 is three-quarter inch high and three inches wide. Upper strip 94 is secured to extend along center line of lower strip 96 so the shoulders 102 are formed by the outer portions of the upper surface of the lower strip. End portion 98 of the upper strip 94 terminate just short or just beyond end portion 100 of lower strip 96 as shown in FIGS. 17 and 18.

Floor clips 89 are secured along spaced horizontal lines and resilient pads 54 are secured to the lower side of strips 96 as previously described. Studs 92 are arranged end to end in slightly spaced fashion as indicated at 104 in FIGS. 17 and 18. Spacing 104 may be as much as one-quarter inch. End 98 of upper strip 94 extends over the projecting end 100 of lower strip 96 so as to provide vertical support at the juncture of adjacent studs 92.

Sleeper D is formed with studs 92 positioned between side members 66 of clips 89 and tabs 26 extending over shoulders 102. Lower strip 96 fits snugly between side members 66 so that lateral movement of sleeper is prevented. Cushions or resilient pads 54 elastically elevate the lower surface of the sleeper from base floor 80 and provides limited vertical movement between tabs 26 and floor 80. Space 104 between ends 98 and 100 allows for changes in the size of studs 92 due to moisture change and prevents bowing of the sleeper. FIG. 18 shows flooring 10 secured to sleeper D by brads 98.

FIG. 19 shows sleeper arrangement E, yet another embodiment of the invention. Sleeper E consists of studs 14 which are of the same type and are arranged as in sleeper arrangement A. Studs 14 have U-shaped mounting clips 106 attached thereto in spaced arrangement. Mounting clips 106 co-operate with floor clips 22 and resilient pads 54 in the manner described of sleepers A and B. Resilient pads 34 could be substituted for resilient pads 54 should it be desired to increase the length of mounting clips 106 to approximately four feet.

Mounting clips 106 consist of a unitary resilient metal member having a pair of one and one half inch opposed side members 110 interconnected at an upper ends with a pair of two and three fourth inch long connecting strips 108. It is not necessary that side members 110 be connected by spaced connecting strips, the upper edges could be interconnected with a single unitary connecting member.

Lower edges of side members 110 are turned out to form one half inch shoulders 112 which are substantially perpendicularly disposed to the side members 110. Shoulders 112 co-operate with floor clips 22 as earlier described to retain sleepers E positioned relative to the base floor.

Mounting clips 106 are preferably made of sixteen gauge galvanized steel although other gauges and metals are suitable. Preferably mounting clips 106 are approximately two inches in length, however, they could also be as much as four feet in length. Mounting clips 106 are generally U-shaped with side members 110 extending from connecting strips 108 in generally a slightly converging fashion. That is lower ends of side members 110 are spaced at a lesser distance from each other than their upper edges.

This arrangement allows mounting clips 106 to elastically engage with studs 14 with sufficient force to remain in position while shoulders 112 of mounting clip 106 are connected with floor clips 22 to secure the studs in position. Mounting clips 106 are permanently secured with the studs 14 with the application of the sub-flooring 10 and flooring 12.

It is understood that while studs 70 and 92 have been described as being formed of plywood, they could alternatively be formed of unitary wood pieces. Also, studs 14 could be formed of plywood strips. It may be desirable to cut a channel along the lower surface of the studs as shown at 32 in FIGS. 1, 2, and 7. If desired, channel 32 may be utilized with sleepers A, B, C, & D.

In some instances it has been found to be desirable to place a cushion or resilient pad member 54 between floor clips and also coincident with all or certain floor clips. Also, it is desirable in most instances to provide that a cushion member 34 or 56 is located adjacent the end of every stud.

while a preferred embodiment of the invention has been described using specific terms, such description is for illustrative purposes only, and it is to be understood that changes and variations may be made without departing from the spirit or scope of the following claims.

What is claimed is:

1. A floor construction for providing resilient support comprising:

a base floor;

a floating support system for attaching flooring to said base floor, said support system comprising a plurality of transversely spaced sleepers arranged in longitudinal lines across said base floor, each said sleeper comprising rectangularly shaped studs arranged end to end along said longitudinal lines;

said sleepers having outwardly directed shoulder members which extend substantially continuously along opposed side portions thereof;

a plurality of longitudinally spaced floor clips arranged along each of said sleepers and attached to said base floor, each said floor clip having at least two spaced vertical side walls adapted to resiliently engage said sleepers therebetween, said side walls having inwardly directed tabs attached to upper ends thereof to extend over said shoulder members;

cushion members arranged intermediate said clips and below said sleepers in spaced relationship, said cushion members separating said studs from said base floor, and each said cushion member having attachment means securing said cushion members with said sleepers; whereby, in use said sleepers are restricted from lateral motion by said side walls and are limited in upward movement by interaction between said tabs and said shoulder members but are allowed limited motion along a vertical axis by compression of said cushion members facilitating a level resilient floor construction.

2. The support system set forth in claim 1 wherein; each of said studs comprise a unitary piece having upper and lower surfaces which are approximately two and one-half inches in width and vertical side walls which are approximately one and one-half inches in height.

3. The support system of claim 1 including side clips having a body portion formed to extend along a plane and having a first and a second edge, each said side clip having attached along said first edge of said body portion a respective one of said shoulder members, said respective one shoulder member being arranged to extend along a plane substantially transverse the plane of said body portion and a second shoulder member attached along said second edge of said body portion to extend oppositely from said one shoulder member.

4. The support system of claim 3 wherein means secure said side clips in opposed relationship with opposed portions of side walls of said sleepers with said second shoulder member of each said side clip extending over a portion of an upper surface of said sleeper and said shoulder member of each said side clip extending along a plane substantially parallel with a lower surface of said sleeper.

5. The support system set forth in claim 4 wherein said second shoulder members rest in channels formed along edge portions of said upper surface.

6. The support system set forth in claim 3 wherein opposed longitudinal slots are provided along vertical side walls of said sleepers, said slots being adapted to receive said second shoulder members of said side clips.

7. The support system of claim 1 including;

U-shaped mounting clips, each including a pair of interconnected opposed side members, each said side member having an outwardly directed lower edge adapted to engage under a respective one of said shoulder members, said mounting clips being adapted to elastically engage with said studs.

8. The support system of claim 7 wherein said opposed side members are interconnected by a plurality of strip members connected with opposed ends of upper edges of said side members.

9. The support system set forth in claim 1 wherein each of said shoulder members comprise an edge portion of a rectangular plate, an edge opposite said edge portion of said plate is formed with knurls which extend along its length.

10. The support system set forth in claim 9 wherein opposed longitudinal slots are provided along vertical side walls of said sleepers, said slots being adapted to receive said opposite edge of said plates, whereby said knurls act to secure said plates in position.

11. The support system set forth in claim 1 wherein each of said cushion members comprises a rectangular shaped elastic pad having a width greater than the width of said sleeper and wherein said attachment means comprise opposed grooves which receive at least an outer portion of said shoulder members.

12. The support system set forth in claim 11 wherein said pads are arranged along said longitudinal lines to be intermediate of said clips.

13. The support system set forth in claim 1 wherein each of said cushion members is provided with a plurality of protruding buttons arranged to extend from a lower surface thereof and adapted to elevate said lower surface above said base floor.

14. The support system set forth in claim 13 wherein there are at least four of said buttons which are equally spaced about said lower surface.

15. The support system set forth in claim 1 wherein each of said cushion members comprises a rectangularly shaped elastic pad of a width which substantially corresponds to the width of said sleeper and said attachment means comprise ears extending from opposite side faces of said cushion member; and tack members penetrating through said ears securing said pad to said sleeper.

16. The support system set forth in claim 1 wherein each of said clips comprise a bottom wall extending between and interconnecting said vertical side walls, an intermediate portion of said bottom wall being bowed upwardly:

attachment means passing through said upwardly bowed portion and into said base floor to resiliently secure said clip against said base floor.

17. The support system set forth in claim 1 wherein each of said studs comprise upper and lower studs secured together along their length with metal plates arranged therebetween in spaced manner along said longitudinal line; and opposed edges of said metal plate forming said shoulder members.

18. The support system set forth in claim 17 wherein said upper and lower studs are secured together with brads; said metal plates being spaced along and between said upper and lower studs; metal strips arranged between said metal plates, said metal strips acting to deflect upwardly ends of said brads to more securely hold said brads in position.

19. The support system set forth in claim 17 wherein said upper and lower studs are formed at different lengths with said studs arranged in opposed relationship end to end, one of said upper and lower ends overlaps the other of said upper and lower ends.

20. The support system set forth in claim 19 wherein said opposed ends of said studs are arranged in spaced relationship.

21. A sleeper system of the type used to attach a covering floor to a base floor, said sleeper system comprising:

a plurality of transversely spaced sleepers arranged in longitudinal lines across said base floor, said sleepers comprising rectangular studs arranged end to end;

each said stud comprising plywood strips secured together in vertical relationship along their length forming upper and lower sections, the lower of said strips being of a greater width than the remainder of said strips forming a shoulder along each side of said studs, end portions of said studs being formed with a recessed ledge so that adjacent end portions of said studs overlap;

resilient pads attached in spaced relationship along the lower surface of said each sleeper, said pads include a rectangular body portion having a width and a length which are substantially equal to the width of said lower surface of said sleeper and a height of approximately one-half inch;

a plurality of buttons projecting from a lower surface of said pads, said buttons acting to elevate said pad body from said base floor, attachment ear extending from opposed sides of said pad body adapted to receive staples therethrough to secure said pads to said lower surface of said sleeper;

clip members arranged longitudinally of each said sleeper, said clip members comprising a lower surface having an upward bow, two side members attached to opposite ends of and extending substantially perpendicular to said lower surface of said clip member and inwardly directed tabs connected to upper edges of said side members; whereby with said clip members secured in position on said base floor, each said sleeper is secured in position between said side members with said tabs positioned over said shoulders so that said sleeper is prevented from transverse movement by said side members and is allowed controlled vertical movement by said resilient pads.

22. The sleeper of claim 21 wherein said resilient pads are formed of recycled rubber.

23. The sleeper of claim 21 wherein said resilient pads have at least four buttons, one located in the proximity of each corner of said resilient pad.

24. The sleeper of claim 21 wherein there are at least three clips arranged along said sleeper.

25. The sleeper of claim 21 wherein there are at least four pads arranged beneath said sleeper.

* * * * *